US006094931A

United States Patent [19]

Jeong

[11] Patent Number: 6,094,931

[45] Date of Patent: Aug. 1, 2000

[54] REFRIGERATOR HAVING DUAL AIR VELOCITY GENERATING APPARATUS FOR AIR CURTAIN FLOW

[75] Inventor: Jae-Youk Jeong, Incheon, Rep. of Korea

[73] Assignee: Daewoo Electronics Co., Ltd., Seoul, Rep. of Korea

[21] Appl. No.: 09/213,867

[22] Filed: Dec. 17, 1998

[30] Foreign Application Priority Data

Oct. 30, 1998 [KR] Rep. of Korea ..... 98-20887

[51] Int. Cl.[7] ..... F25D 17/08

[52] U.S. Cl. ..... 62/407; 62/256; 454/193

[58] Field of Search ..... 62/256, 407, 408, 62/419, 426; 454/193

[56] References Cited

U.S. PATENT DOCUMENTS

| | | | |
|---|---|---|---|
| 3,233,423 | 2/1966 | Beckwith et al. | 62/256 |
| 4,058,989 | 11/1977 | Horvay et al. | 62/256 |
| 4,379,391 | 4/1983 | Rhee | 62/256 |
| 4,807,446 | 2/1989 | Sunaga | 62/256 |
| 5,675,581 | 10/1997 | Soliman | 370/252 |
| 5,784,895 | 7/1998 | Choi | 62/407 |
| 5,791,152 | 8/1998 | Choi | 62/256 |
| 5,809,799 | 9/1998 | Jeon | 62/408 |
| 5,826,441 | 10/1998 | Oh | 62/256 |

FOREIGN PATENT DOCUMENTS 0 334678A1 9/1989 European Pat. Off. .

*Primary Examiner*—William E. Tapolcai
*Attorney, Agent, or Firm*—Jacobson, Price, Holman & Stern, PLLC

[57] ABSTRACT

A refrigerator having dual air velocity generating apparatus for air curtain flow comprises a cool air supply duct through which cool air is supplied to an upper opening of a food storage chamber by operation of a fan, and a dual air velocity generating apparatus provided at an exit of the cool air supply duct for transforming the air curtain flow discharged through the exit with the dual air velocity, thereby decreasing the velocity of the air curtain flow distal to the food storage chamber than that proximal to the food storage chamber.

5 Claims, 6 Drawing Sheets

REFRIGERATOR HAVING DUAL AIR VELOCITY GENERATING APPARATUS FOR AIR CURTAIN FLOW

BACKGROUND OF THE INVENTION

1. Field of the Invention

The present invention relates to a refrigerator for air curtain flow. More specifically, the invention relates to a refrigerator having a dual air velocity generating apparatus for air curtain flow, thereby decreasing the velocity of the air curtain flow distal to the food storage chamber than that proximal to the food storage chamber.

2. Description of the Prior Art

A conventional refrigerator is illustrated in FIGS. 6 and 7, which comprises a freezing chamber 1 and a refrigerating chamber 2. A compressor 10 is mounted on a rear lower portion of the refrigerator, and an evaporator 20 is provided at a rear portion of the refrigerating chamber 2. A refrigerant is compressed by operation of the compressor 10, and the compressed refrigerant flows toward the evaporator 20, thereby cooling the circulating air by the evaporation of the refrigerant.

Fans 23, 24 for circulating cool air are provided at the rear portion of the freezing chamber 1, and the air cooled through the evaporator 20 is supplied to the freezing chamber 1 and the refrigerating chamber 2 via each cool air duct which will be illustrated later.

The cool air duct 25 is provided in a rear portion of the freezing chamber 1, and the cool air forcedly enters into the cool air duct 25 by the operation of the fan 23, and further enters into the freezing chamber 1 through a plurality of openings 27 formed at a duct cover 25C provided between the freezing chamber 1 and the evaporator 20.

Another cool air duct 26 is formed behind the cool air duct 25 opposite to the freezing chamber 1. The duct 26 is branched in two passages 26A,26B, preferably, and each passage is further extended down along each rear side of the refrigerating chamber 2. The cool air forcedly enters into each passage 26A,26B by the operation of another fan 24, and further enters into the refrigerating chamber 2 through a plurality of openings 28 formed at a duct cover 26C. Preferably, other openings 29 channeled from corresponding passages 26A,26B are provided at each inner side wall of the refrigerating chamber 2.

A cool air supply duct 42 is arranged under a partition wall 41 divided from the freezing chamber 1 and the refrigerating chamber 2, which extends from the rear portion of the refrigerating chamber 2 to the front portion of the refrigerating chamber 2. A chamber 42*a* for housing an air curtain fan 44 is formed at one end of the duct 42 proximal to the rear portion of the refrigerating chamber 2, and an air discharge opening 43 is formed at another end of the duct 42 opposite to the chamber 42*a*. The air discharge opening 43 is preferably formed along the entire width of the upper portion of an accessible opening 20C of the refrigerating chamber 2.

The fan 44 for generating the air curtain stream is housed in the chamber 42*a*, thereby enabling the air to flow smoothly. Preferably, the length of the fan 44 corresponds to the inner width of the chamber 42*a*, and is operated by additional motor 46.

Since the upper surface of the duct 42 is flatly extended, and the lower surface of the duct 42 is sloped up to the air discharge opening 43, the cross-section area of the duct 42 is decreased more and more toward the opening 43. The velocity of the cool air flowing along near the upper inner surface of the air duct 42 is faster than that of the air along the lower inner surface of the air duct 42. A front end of the bent discharge opening 43 of the duct 42 is straight which causes the discharging cool air to flow straight.

An air collecting duct 47 is extended down along a rear center portion of the refrigerating chamber 2, and plural air collecting openings 48,48A,48B channeled from the air collecting duct 47 are formed at a duct cover 47C.

The refrigerating chamber 2 is divided by plural shelves 49,49A,49B , the upper surface of which is preferably flat-shaped to enhance effective air collection. A cross-section area of the opening 48 formed at the uppermost area of the refrigerating chamber 2 is smaller than that of the opening 48A formed at the middle height area of the refrigerating chamber 2, and a cross-section area of the opening 48A is smaller than that of the opening 48B formed at the lower height area of the refrigerating chamber 2. Height of each opening 48,48A,48B is determined according to volume of storage foodstuffs, but each opening 48,48A, 48B is preferably formed at approximately halfway up each shelf 48,48A,48B. Further, each opening 48,48A,48B has a rectangular shape having a long longitudinal side or an oval shape.

The operation of the refrigerator configurated above is illustrated as follows. When a door (not shown) is opened, the fan 44 commences operation, and simultaneously the fan 24 terminates operation. The cool air is discharged through the opening 43 by the operation of the fan 44, thus forming the cool air curtain. The cool air circulating in the refrigerating chamber 2 does not escapes from the refrigerating chamber 2, thereby maintaining a constant temperature of the refrigerating chamber.

However, even if the cool air discharged from the opening 42 has the same low temperature between the distal layer and the proximal layer to the refrigerating chamber, the temperature of the distal layer of the air curtain increases greatly while the air stream flows downward in contact with ambient temperature air. Therefore, the air curtain flow has high temperature and the air enters into the refrigerating chamber. The high temperature air further flows into each air collecting opening, and recirculates in the refrigerating chamber. Thus, there is a problem in that the temperature of the refrigerating chamber increases, causing a decline in the cooling efficiency of the refrigerator.

SUMMARY OF THE INVENTION

It is an object of the present invention to provide a refrigerator having dual velocity generating apparatus for air curtain flow which solves the above problems.

It is another object of the present invention to provide a refrigerator having dual velocity generating apparatus for air curtain flow through which an air curtain flow has a dual air velocity, thereby resulting the overall efficiency of the refrigerator to be improved.

To achieve the above object of the present invention, a refrigerator having dual air velocity generating apparatus for air curtain flow comprises an evaporator for generating cool air, a cool air supply duct through which the cool air is supplied to an upper portion of an access opening of a food storage chamber by operation of a fan, an air collection duct through which the air discharged from the upper portion of the access opening toward a lower portion of the access opening and circulated in the food storage chamber flows to the evaporator, a partition plate longitudinally extended in the cool air supply duct and dividing the cool air supply duct into an upper air passage and a lower air passage, and an upper honeycomb provided at an exit of the upper air passage and a lower honeycomb provided at an exit of the lower air passage.

Further, a traverse cross-section of the upper air passage is smaller than that of the lower air passage.

Furthermore, a size of each hole of the upper honeycomb is larger than that of the lower honeycomb.

Alternatively, a refrigerator having dual air velocity generating apparatus for air curtain flow comprises an evaporator for generating cool air, a cool air supply duct through which the cool air is supplied to an upper opening of a food storage chamber by operation of a fan, an air collection duct through which the air circulated in the food storage chamber flows to the evaporator, and a dual air velocity generating apparatus provided at an exit of the cool air supply duct for transforming the air curtain flow discharged through the exit with the dual air velocity, thereby decreasing the velocity of the air curtain flow distal to the food storage chamber than that proximal to the food storage chamber.

Further, the dual air velocity generating apparatus comprises a partition plate longitudinally extended in the cool air supply duct and dividing the cool air supply duct into an upper air passage and a lower air passage, and an upper honeycomb provided at an exit of the upper air passage and a lower honeycomb provided at an exit of the lower air passage.

DETAILED DESCRIPTION OF THE PREFERRED EMBODIMENT

Figure 1:
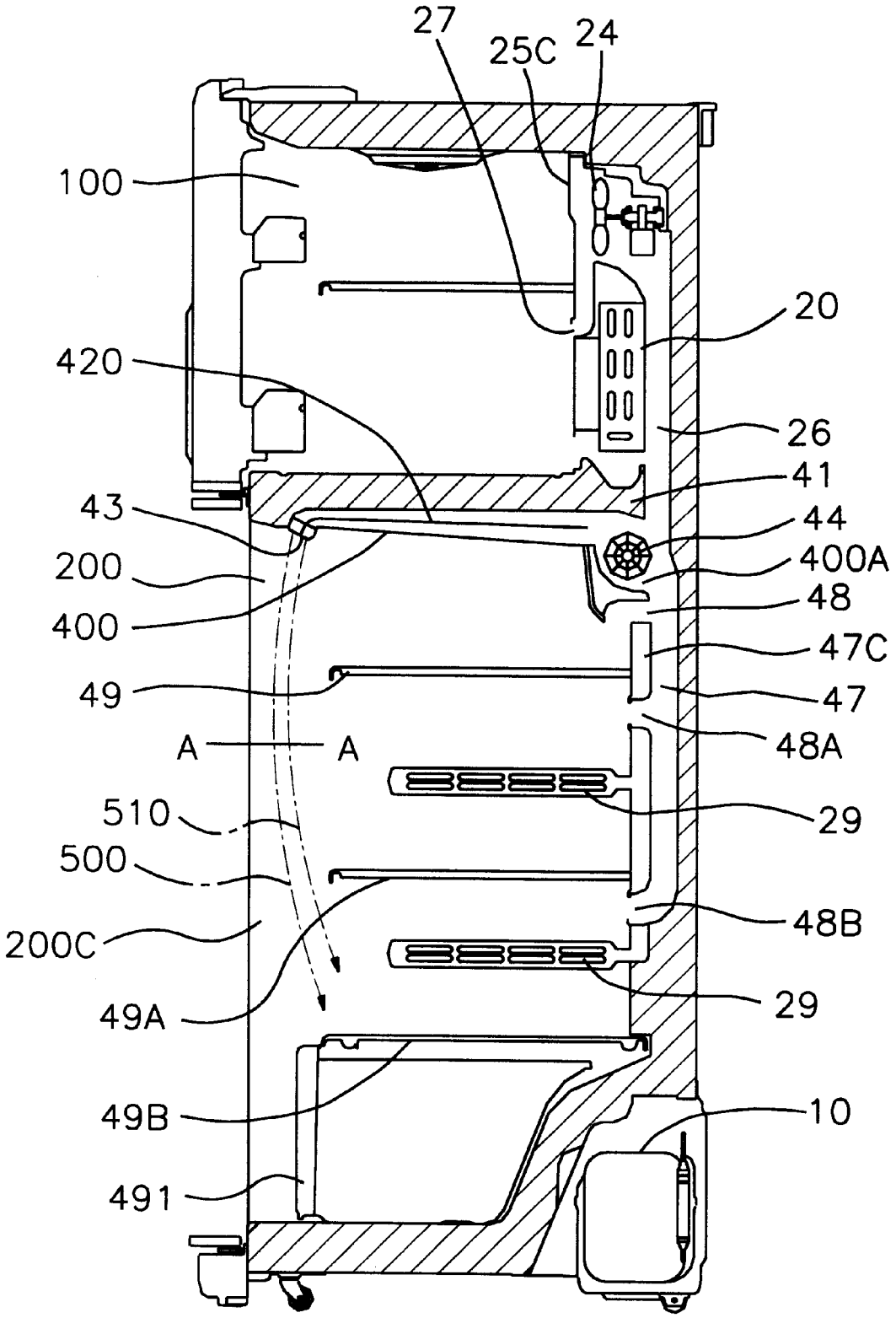
FIG. 1 is a side vertical cross-sectional view of a refrigerator having dual air velocity generating apparatus according to a present invention.
Figure 2:
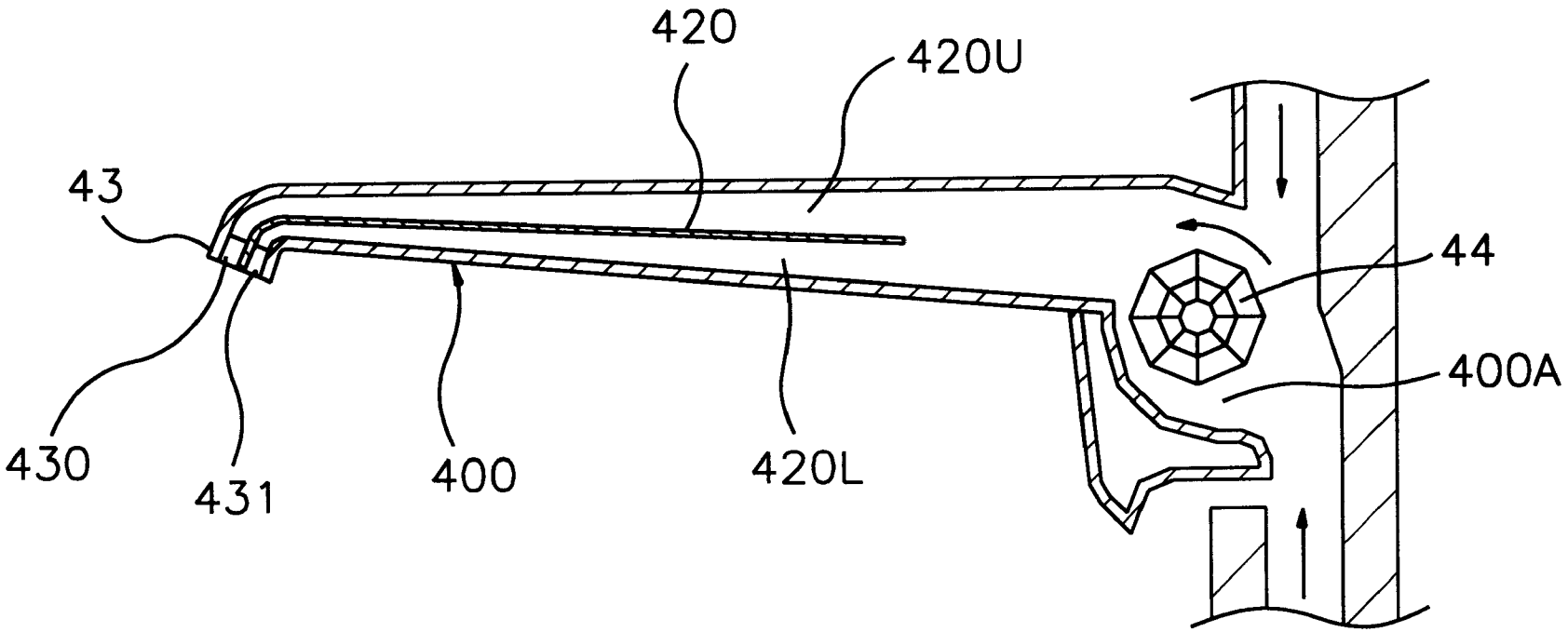
FIG. 2 is an enlarged side cross-sectional view of the dual air velocity generating apparatus of FIG. 1.
Figure 3:
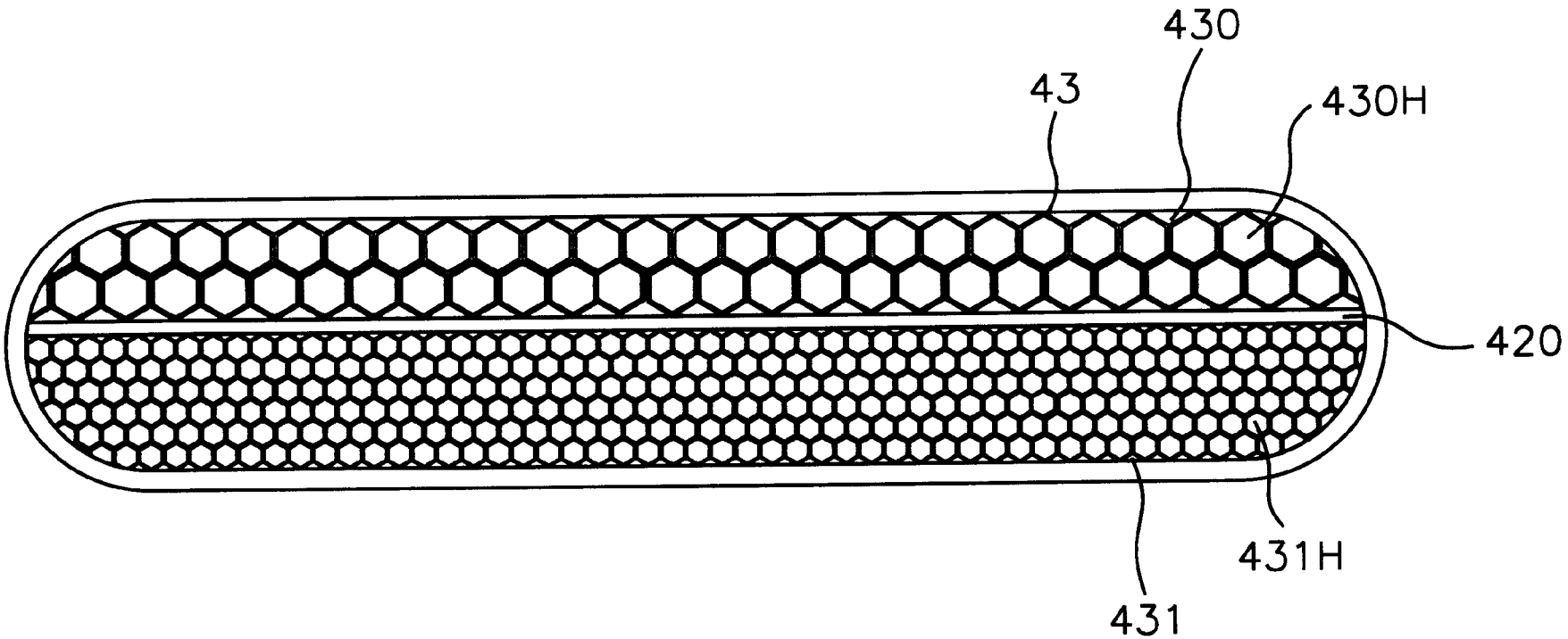
FIG. 3 is an enlarged front view of a honeycomb of air passage of FIG. 2.

FIGS. 1, 2 and 3 illustrate a refrigerator having dual air velocity generating apparatus for air curtain flow according to the present invention. Hereafter, components which are the same as that of the prior art are designated by the same numerals. Thus, no detailed explanation of those components will be provided.

The refrigerator comprises a freezing chamber 100 and a refrigerating chamber 200. A compressor 10 is mounted on a rear lower portion of the refrigerator, and an evaporator 20 is provided at a rear portion of the refrigerating chamber 2. A refrigerant is compressed by operation of the compressor 10, and the compressed refrigerant flows toward the evaporator 20, thereby cooling the circulating air by the evaporation of the refrigerant.

Fans 24 (one is not shown in the drawing) for circulating cool air are provided at the rear portion of the freezing chamber 100, and the air cooled through the evaporator 20 is supplied to the freezing chamber 100 and the refrigerating chamber 200 via each cool air duct which will be illustrated later.

The cool air duct (not shown) is provided in a rear portion of the freezing chamber 100, and the cool air forcedly enters into the cool air duct by the operation of the fan, and further enters into the freezing chamber 100 through a plurality of openings 27 formed at a duct cover 25C provided between the freezing chamber 100 and the evaporator 20.

Another cool air duct 26 is formed behind the cool air duct opposite to the freezing chamber 100. The duct 26 is branched in two passages (not shown) preferably, and each passage is further extended down along each rear side of the refrigerating chamber 200. The cool air forcedly enters into each passage by the operation of another fan 24, and further enters into the refrigerating chamber 200 through a plurality of openings (not shown) formed at a duct cover (not shown). Preferably, other openings 29 channeled from corresponding passages (not shown) are provided at each inner side wall of the refrigerating chamber 200.

A cool air supply duct 400 is arranged under a partition wall 41 divided from the freezing chamber 100 and the refrigerating chamber 200, which extends from the rear portion of the refrigerating chamber 200 to the front portion of the refrigerating chamber 200. A chamber 400*a* for housing an air curtain fan 44 is formed at one end of the duct 400 proximal to the rear portion of the refrigerating chamber 200, and an air discharge opening 43 is formed at another end of the duct 400 opposite to the chamber 400*a*. The air discharge opening 43 is preferably formed along the entire width of the upper portion of an accessible opening 200C of the refrigerating chamber 200.

The fan 44 for generating the air curtain stream is housed in the chamber 400*a*, thereby enabling the air to flow smoothly. Preferably, the length of the fan 44 corresponds to the inner width of the chamber 400*a*, and is operated by an additional motor (not shown).

The duct 400 has a partition plate 420 which is longitudinally extended, and which is divided into an upper air passage 420U and a lower air passage 420L. A traverse cross-section of the upper air passage 420U is smaller than that of the lower air passage 420L. Since the upper surface of the duct 400 is flatly extended, and the lower surface of the duct 400 is sloped up to the air discharge opening 43, the total traverse cross-section of the duct 400 decreases progessively toward the opening 43.

An upper honeycomb 430 is provided at an exit of the upper air passage 420U, while a lower honeycomb 431 is provided at an exit of the lower air passage 420L, through both of which the cool air flows toward the lower portion of the access opening 200C as the air curtain flow.

A size of each hole 430H of the upper honeycomb 430 is larger than that of each hole 431H of the lower honeycomb 431. Thus, the total number of holes 430H of the upper honeycomb 430 is smaller than the total number of holes 431H of the lower honeycomb 431.

The detailed explanation of the air collection duct system is omitted for the purpose of avoiding repetition.

The operation of the refrigerator configurated above is illustrated as follows. When a door (not shown) is opened, the fan 44 commences operation, and simultaneously the fan 24 terminates operation. The cool air flows along the duct 400 through the opening 43 by the operation of the fan 44. The air flowing along the upper air passage 420U enters into the upper honeycomb 430, while the air flowing along the lower air passage 420L enters into the lower honeycomb 431. The air passing through both honeycombs 430,431 flows down to the lower portion of the refrigerating chamber 200, and forms an air curtain flow shown in FIG. 1. The air layer passing through the upper honeycomb 430 or the distal layer to the refrigerating chamber 200 is designated as an exterior air flow 500, and the air layer passing through the lower honeycomb 431 or the proximal layer to the refrigerating chamber 200 is designated as an interior air flow 510.

Figure 4:
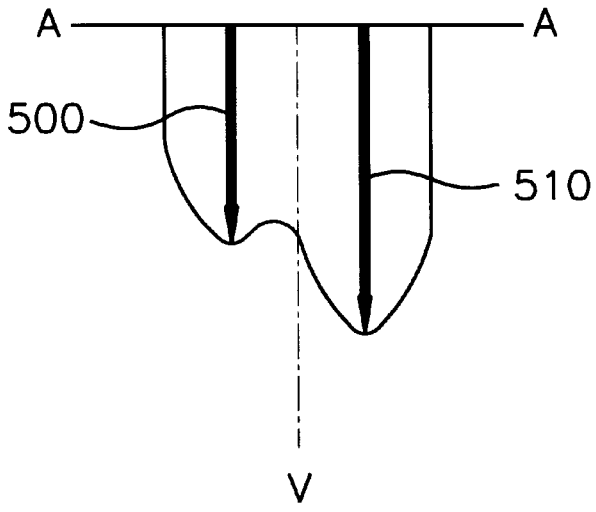
FIG. 4 is a schematic representation of velocity distribution of an air curtain flow taken on line A—A of FIG. 1.
Figure 5:
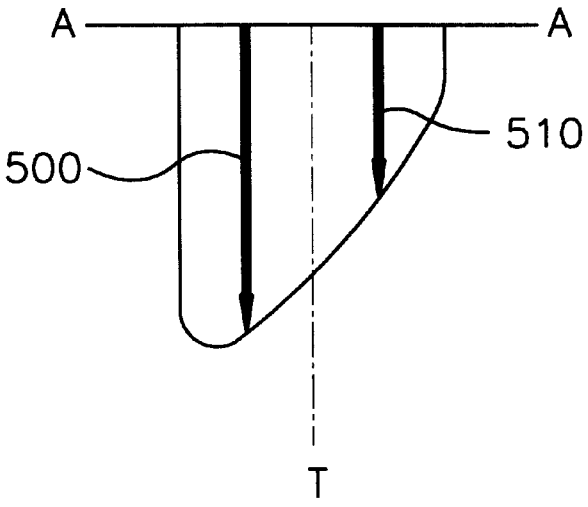
FIG. 5 is a schematic representation of temperature distribution of an air curtain flow taken on line A—A of FIG. 1.

The velocity of the interior air flow 510 becomes relatively faster than that of the exterior air flow 500 as shown in FIG. 4. It occurs because the size of a lower honeycomb hole 431H is smaller than that of an upper honeycomb hole 430H. The temperature of the exterior air flow 500 increases gradually as the exterior air flow 500 flows downward in contact with ambient temperature air as shown in FIG. 5.

Figure 6:
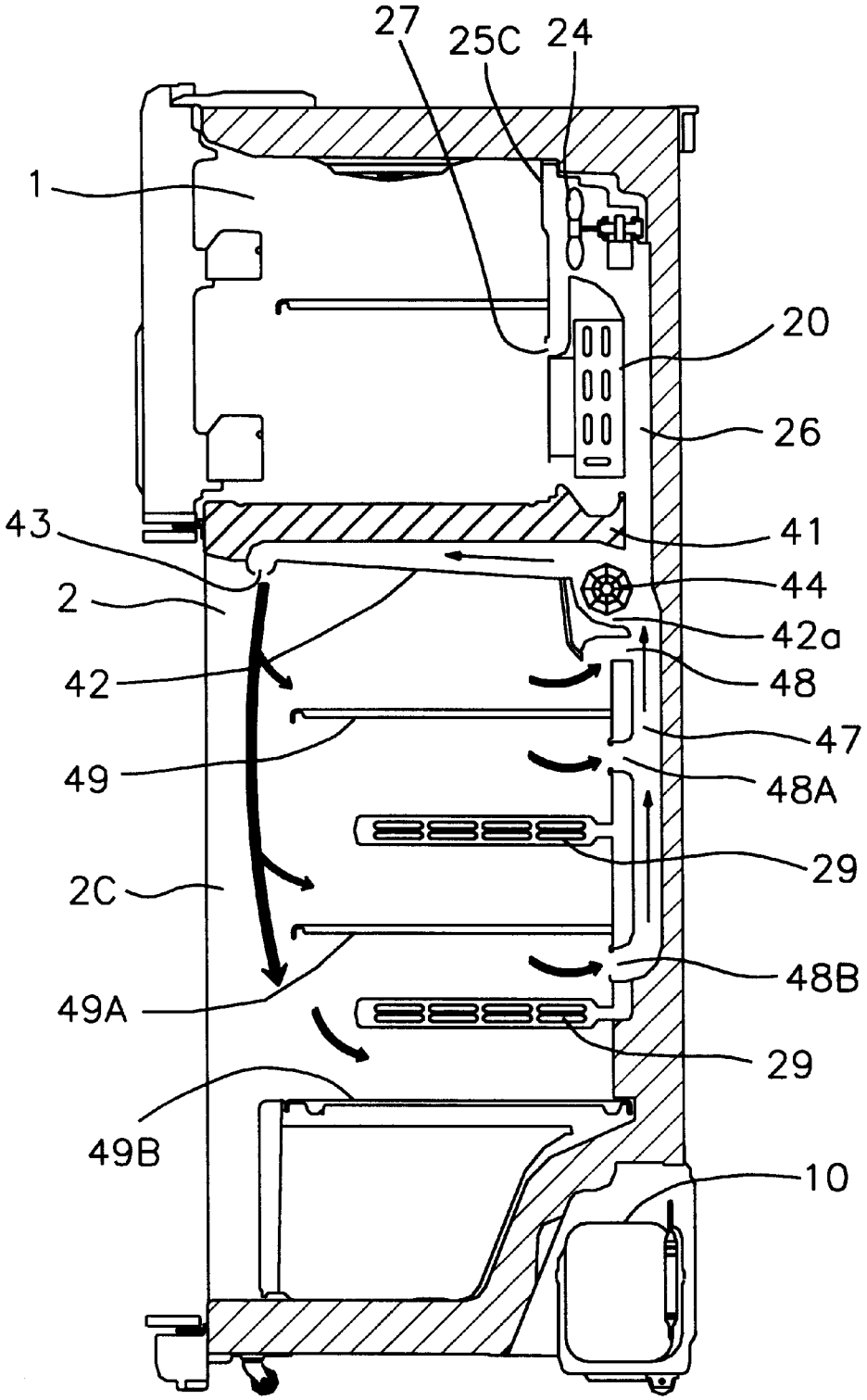
FIG. 6 PRIOR ART
FIG. 6 is a side vertical cross-sectional view of a refrigerator having air curtain flow according to a prior art.
Figure 7:
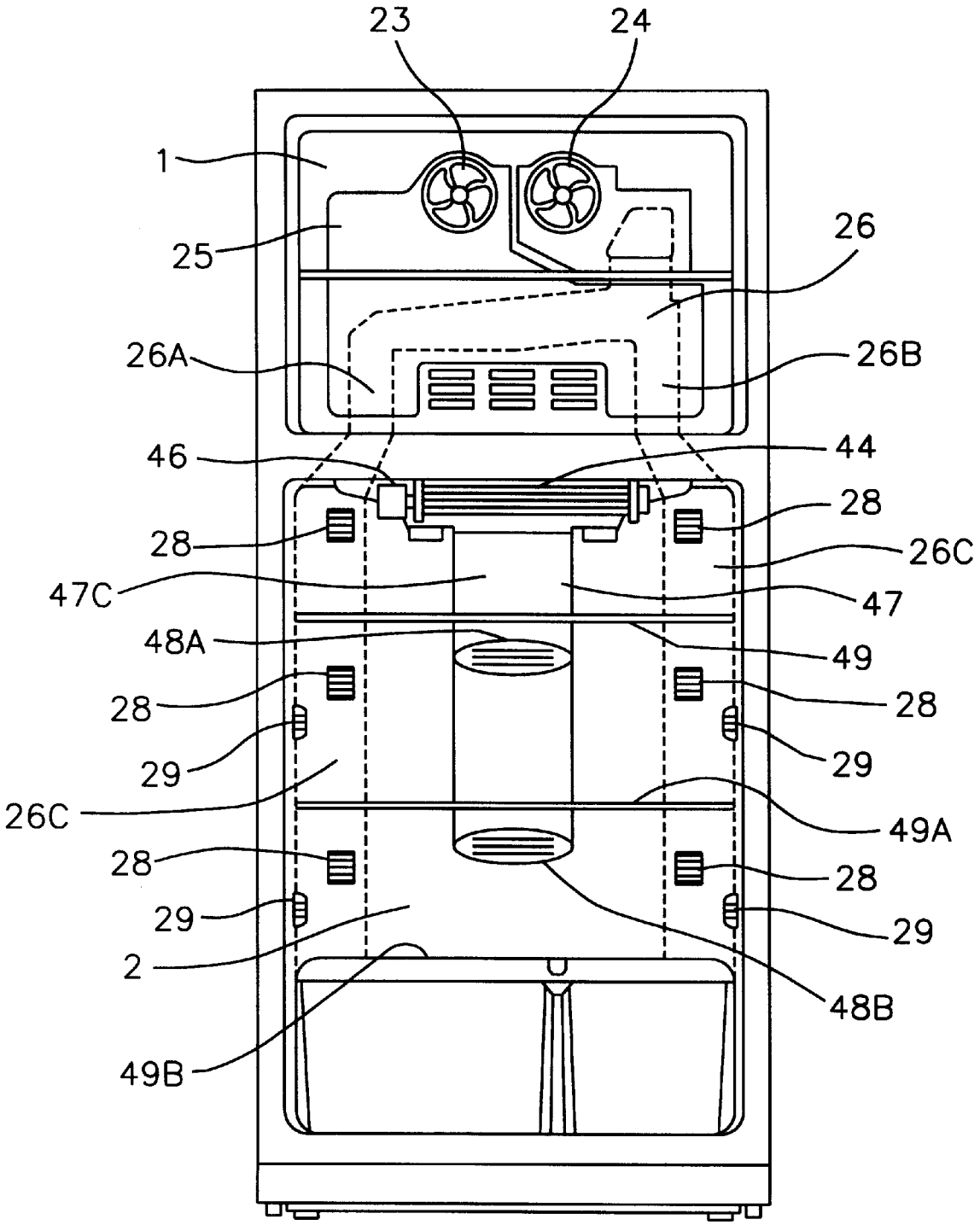
FIG. 7 PRIOR ART
FIG. 7 is a front view of a refrigerator having air curtain flow of FIG. 6.

Since the exterior air flow 500 has relatively faster velocity than the interior air flow 510, the pressure of the exterior air flow 500 is relatively larger than that of the interior air flow 510, and also is larger than that of the air curtain flow passing through the conventional air supply duct 42 (refer to FIG. 6).

The expelling force of the exterior air flow 500 against ambient air is relatively larger than that of the conventional air curtain flow. The ambient air is hindered from contacting with the exterior air flow, thus preventing the temperature of the air curtain flow from increasing significantly. Thus, the interior air flow 510 maintains a relative low temperature and enters into the refrigerating chamber. The cool air further flows into each air collection opening, and recirculates in the refrigerating chamber, thereby maintaining a constant low temperature in the refrigerating chamber.

According to the present invention, the cool air is supplied to an upper portion of an access opening of a refrigerating chamber through the air supply duct. While flowing along the air supply duct, the cool air is divided into two air flows, one of which passes through wide channel honeycomb, and another of which passes through narrow channel honeycomb. Therefore, the velocity of each air flow passing through respective honeycomb is different. The exterior air curtain layer flow having slower velocity and high pressure expels ambient air, and thus the interior air curtain layer flow maintains the low temperature, thereby causing the overall efficiency of the refrigerator to be improved.

What is claimed is:

1. A refrigerator having dual air velocity generating apparatus for air curtain flow comprising:

an evaporator for generating cool air;

a cool air supply duct through which the cool air is supplied to an upper portion of an access opening of a food storage chamber by operation of a fan;

an air collection duct through which the air discharged from the upper portion of the access opening toward a lower portion of the access opening and circulated in the food storage chamber flows to the evaporator;

a partition plate longitudinally extended in the cool air supply duct and dividing the cool air supply duct into an upper air passage and a lower air passage; and an upper honeycomb provided at an exit of the upper air passage and a lower honeycomb provided at an exit of the upper air passage and a lower honeycomb provided at an exit of the lower air passage, a size of each hole of the upper honeycomb is larger than that of the lower honeycomb.

2. The refrigerator having dual air velocity generating apparatus for air curtain flow according to claim 1, wherein a traverse cross-section of the upper air passage is smaller than that of the lower air passage.

3. A refrigerator having dual air velocity generating apparatus for air curtain flow comprising:

an evaporator for generating cool air;

a cool air supply duct through which the cool air is supplied to an upper opening of a food storage chamber by operation of a fan;

an air collection duct through which the air circulated in the food storage chamber flows to the evaporator; and a dual air velocity generating apparatus provided at an exit of the cool air supply duct for transforming the air curtain flow discharged through the exit with the dual air velocity, thereby decreasing the velocity of the air curtain flow distal to the food storage chamber than that proximal to the food storage chamber, a size of each hole of the upper honeycomb is larger than that of the lower honeycomb.

4. The refrigerator having dual air velocity generating apparatus for air curtain flow according to claim 3, wherein the dual air velocity generating apparatus comprises a partition plate longitudinally extended in the cool air supply duct and dividing the cool air supply duct into an upper air passage and a lower air passage; and an upper honeycomb provided at an exit of the upper air passage and a lower honeycomb provided at an exit of the lower air passage.

5. The refrigerator having dual air velocity generating apparatus for air curtain flow according to claim 4, wherein a traverse cross-section of the upper air passage is larger than that of the lower air passage.

* * * * *